US006076446A

United States Patent [19]

Onishi et al.

[11] Patent Number: 6,076,446

[45] Date of Patent: Jun. 20, 2000

[54] RECIPROCATING MECHANISM OF A SHEET MATERIAL CUTTING DEVICE

[75] Inventors: Takamasa Onishi; Zentaro Kamura, both of Gumma, Japan

[73] Assignee: Onishilite Industry Co., Ltd., Japan

[21] Appl. No.: 08/871,982

[22] Filed: Jun. 10, 1997

[30] Foreign Application Priority Data

Jun. 2, 1996 [JP] Japan ..... 8-159572

[51] Int. Cl.[7] ..... B26D 1/18; B26D 1/20

[52] U.S. Cl. ..... 83/487; 83/578; 83/614

[58] Field of Search ..... 83/614, 940, 941, 83/578, 455, 487; 74/27, 37

[56] References Cited

U.S. PATENT DOCUMENTS

| | | | |
|---|---|---|---|
| 4,084,681 | 4/1978 | Heinzel et al. | 74/37 |
| 4,085,621 | 4/1978 | Hadaway | 74/37 |
| 4,088,034 | 5/1978 | Wallis | 74/37 |
| 4,227,421 | 10/1980 | Weishew | 74/37 |
| 4,266,456 | 5/1981 | Oostvogels | 74/37 |
| 4,315,683 | 2/1982 | Schmaling et al. | 74/37 |
| 4,372,698 | 2/1983 | Matsushima | 74/37 |
| 5,431,077 | 7/1995 | Murakami | 83/614 |

*Primary Examiner*—Kenneth E. Peterson
*Attorney, Agent, or Firm*—Rader, Fishman & Grauer

[57] ABSTRACT

The present invention provides a carriage reciprocating mechanism permitting easy reversal of the traveling direction of a carriage without changing the rotating direction of a motor or the traveling direction of an endless belt, and without rotating of the carriage itself, when the carriage reaches the end point of travel. The carriage can reverse the traveling direction thereof at the end point of travel by movement in only one direction of an endless belt stretched between a driving pulley arranged at one end of the frame and a follower pulley arranged at the other end thereof. Particularly, a reciprocating mechanism of a sheet-cutting device may have a carriage or a tool post provided allowing movement across a sheet to be cut relative to a frame. A rotary blade of the sheet-cutting device is supported by bearings on the tool post. A fixed blade of the sheet-cutting device can be arranged so as to come into contact with the rotary blade, and cutting the sheet with the assistance of the rotary blade and the fixed blade upon travel of the tool post.

5 Claims, 15 Drawing Sheets

RECIPROCATING MECHANISM OF A SHEET MATERIAL CUTTING DEVICE

BACKGROUND OF THE INVENTION

1. Field of the Invention

The present invention relates to a reversing mechanism of the traveling direction at the end point of travel of a carriage connected to an endless belt stretched between a driving pulley and a follower pulley and reciprocating under the effect of movement of the endless belt, and further, to a reciprocating mechanism of a tool post using the foregoing reversing mechanism in a sheet material cutting device cutting a sheet material with the assistance of a rotary blade traveling while rotating and a fixed blade in contact with the rotary blade.

2. Description of the Related Art

In prior known printers for a terminal such as a cash register, a strip-shaped sheet material wound into a roll is pulled out for printing, and then the necessary portion is cut into a sheet for delivery by a cutter.

Various types of such sheet material cutters are available. The rotary-type cutter is costly to manufacture and creates a relatively high degree of noise and therefore is now being replaced by a cutter based on a combination of a circular rotary cutting blade moving while rotating and a fixed cutting blade formed into a long sheet.

A cutting device of this type will be described below with reference to FIG. 16. A tool post 100 supporting a rotary blade 102 is screw-connected to a screw shaft 101. When the screw shaft 101 is rotated by a driving device such as a motor not shown, the tool post 100 travels on the screw shaft 101 from right to left and vice versa. The rotary blade 102 is supported by bearings for rotation by a shaft 103 provided on the tool post 100, and pressed against a fixed blade 104 by a spring 105, for example. When the screw shaft 101 is rotated by the motor, the tool post 100 travels from right to left and vice versa in FIG. 16, depending upon the rotating direction of the screw. A sheet material transferred vertically in the drawing is cut with the assistance of the rotary blade 102 and the fixed blade 104.

Apart from the above, a well-known device is based on a reciprocating mechanism using an endless wire 110 in place of the screw shaft to serve as the traveling mechanism of the tool post 100, as shown in FIG. 17. This reciprocating mechanism comprises a driving pulley 111, a follower pulley 112, an endless wire 110 stretched between these pulleys 111 and 112, and a motor (not shown) for rotating the driving pulley. The tool post 100 is fixed to the endless wire 110. Rotating the driving pulley 111 moves the endless wire 110, and moves the tool post 100 along a guide 113 provided on a frame as it is pulled by the endless wire 110. In the same manner as in the above-mentioned conventional case, the sheet material transferred vertically in the drawing is cut with the assistance of the rotary blade 102 and the fixed blade 104.

In the devices described above, however, it is necessary, in order to reverse the tool post at the end point of travel, to detect arrival of the tool post at the end point of travel, reverse the rotation of the motor by means of a switching mechanism, reverse the rotation of the screw shaft and the driving pulley, and thus reverse the traveling direction of the tool post. It is therefore necessary to provide the foregoing devices with two sensors to detect the arrival of the tool post at the right and the left end points, and in addition, to provide a switching mechanism for rotating the motor in two directions. This factor prevents reducing the cost of the devices.

In view of the present circumstances as described above, the present inventor carried out extensive studies to develop a reciprocating mechanism of a tool post capable of easily reversing the traveling direction upon arrival of the tool post at the end point of travel while maintaining a uniform direction of motor rotation, and as a result, successfully developed the following:

a reversing mechanism of a carriage capable of reversing the traveling direction of a carriage that is connected to an endless belt stretched between a driving pulley and a follower pulley, and reciprocating under the effect of travel of the endless belt, and upon arrival of the carriage at an end point of travel thereof, without changing the traveling direction of the endless belt; and a reciprocating mechanism of a sheet material cutting device by the application of the foregoing reversing mechanism of a carriage.

The present invention is characterized in that a sliding piece connecting the carriage and the endless belt that travels on the carriage upon arrival of the carriage at the end point of travel, and the traveling direction of the carriage can thus be easily reversed at the end point of travel without changing the rotating direction of the motor or the traveling direction of the endless belt by changing the connecting point of the carriage and the endless belt. Thus, it is possible to reduce the number of sensors provided at the end point of travel and eliminate the switching mechanism for changing the rotating direction of the motor.

When the foregoing reversing mechanism of a carriage is applied for a sheet material cutting device, the sliding piece connecting the tool post and the endless belt is caused to travel on the tool post upon arrival of the tool post at the end point of travel to change the connecting point of the tool post and the endless belt, thereby permitting the traveling direction of the tool post to be easily reversed without changing the rotating direction of the motor or the traveling direction of the endless belt, thus allowing reduction of the number of sensors to be provided at the end point of travel, elimination of the switching mechanism for changing the rotating direction of the motor, and considerable cost reduction of the sheet-cutting device.

SUMMARY OF THE INVENTION

The technical features for solving these problems adopted in the present invention include a reversing mechanism of a carriage where the traveling direction of a carriage is connected to an endless belt stretched between a driving pulley and a follower pulley. The carriage reciprocates under the effect of movement of the endless belt. The movement of the carriage can be changed at the end point of travel by movement of the end less belt without changing the direction, of the belt movement. In another aspect the reciprocating mechanism can be used with a tool post in a sheet material cutting device carried by the tool post that can move across the sheet material relative to a frame. The cutting device includes a rotary blade supported with bearings by this tool post and a fixed blade arranged, which can come into contact with the rotary blade and cuts the sheet material with the assistance of the rotary blade and the fixed blade during travel of the tool post. The tool post is capable of reversing the traveling direction thereof at the end point of travel by movement of the endless belt stretched between the driving pulley arranged at an end of the frame and the follower pulley arranged at the other end without changing the belt moving direction.

DESCRIPTION OF THE PREFERRED EMBODIMENTS

Embodiments of the present invention will now be described below with reference to the drawings. Because the reversing mechanism of a carriage and the tool post reciprocating mechanism of a sheet material cutting device have the same mechanical configurations, the following description will cover the tool post reciprocating mechanism of the sheet material cutting device achieved by the application of the reversing mechanism of a carriage as an example.

Figure 1:
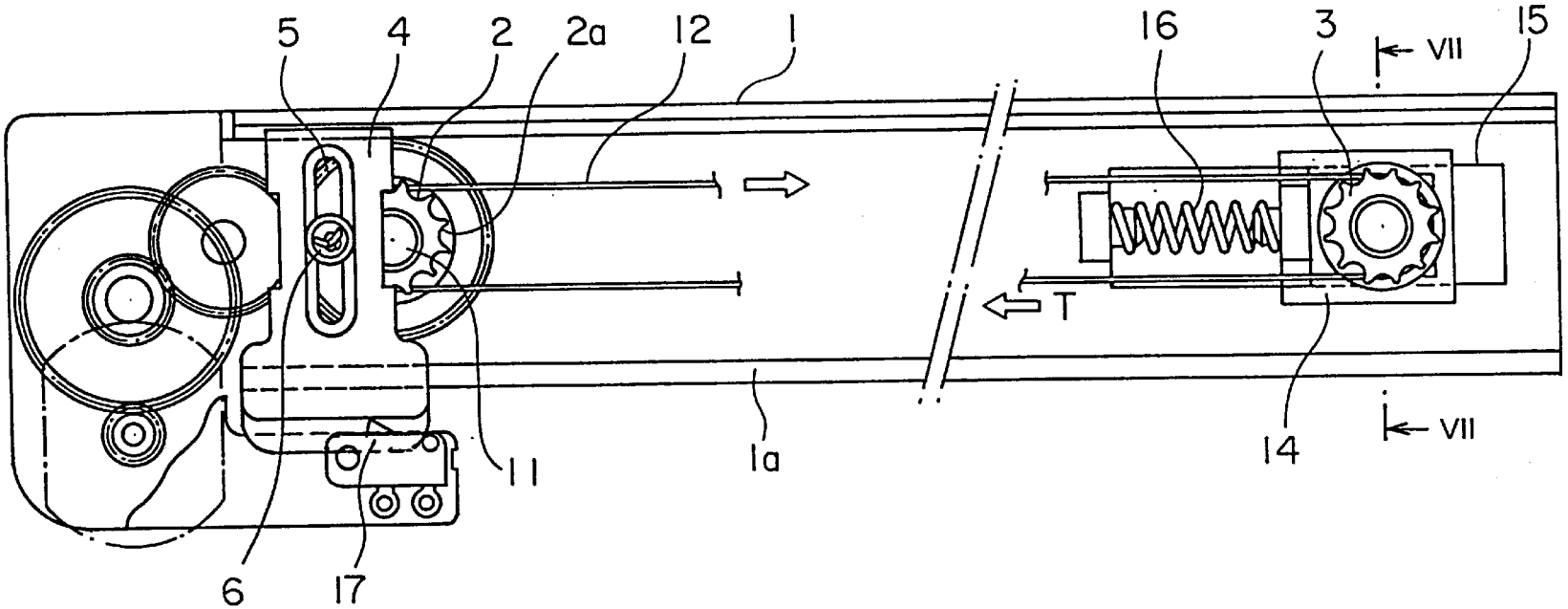
FIG. 1 is a plan view of the reversing mechanism or the tool post reciprocating mechanism of a sheet material cutting device of a first embodiment of the present invention.
Figure 2:
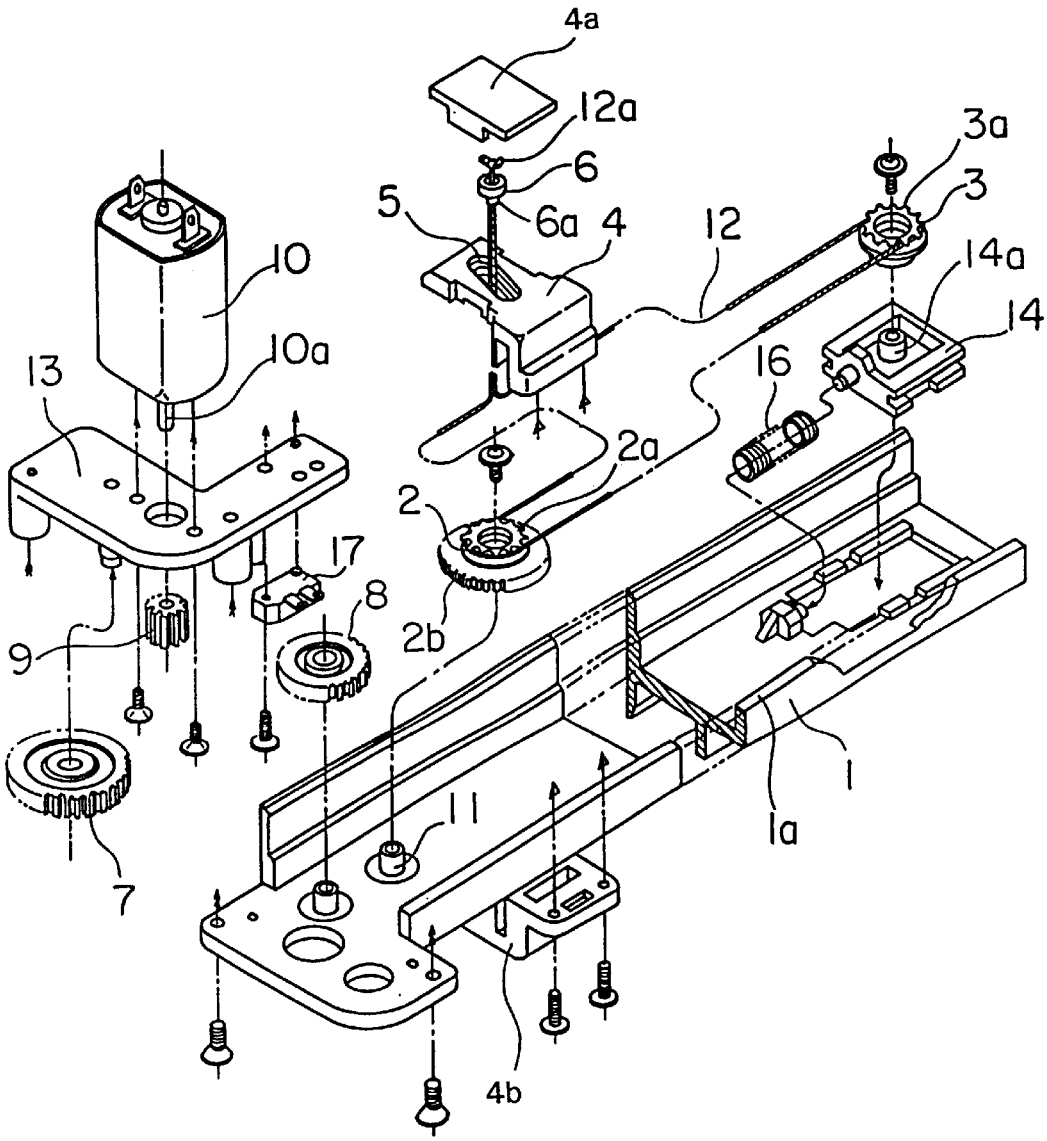
FIG. 2 is an exploded perspective view of the reversing mechanism, or the tool post reciprocating mechanism of the sheet material cutting device of the first embodiment of the present invention.

FIG. 1 is a schematic plan view of a tool post reciprocating mechanism of a first embodiment of the present invention, and FIG. 2 is an exploded perspective view of that mechanism. In both drawings, the rotary blade and the fixed blade for cutting a sheet material are omitted. Furthermore, since the sheet material cutting device has the same basic configuration as that of the conventional one, the feature portion of the reversing mechanism (i.e., reciprocating mechanism) is emphasized in both drawings. For the rotary blade and the fixed blade of the sheet material cutting device and the detailed configuration of the sheet material cutting device, ones disclosed in Japanese Unexamined Patent Publication No. 5-200694 (corresponding to U.S. Pat. No. 5,307,716) proposed by the present inventor may be adopted.

In FIGS. 1 and 2, a guide 1*a* is formed in the frame 1, and a carriage 4 or a tool post (moving object) 4 is fitted and provided allowing sliding movement in this guide 1*a*. A driving pulley 2 and a follower pulley (tension pulley) 3 are supported while allowing rotation at the ends of the frame 1. An endless belt 12 (or an endless wire in this embodiment) is stretched between the driving pulley 2 and the follower pulley 3. The foregoing tool post 4 is connected to the endless wire 12 by a sliding piece 6, which will be described later, and movement of the endless wire 12 pulls the tool post 4 to move on the frame 1. By movement of the endless wire 12 in only one direction (the direction of arrow T in FIG. 1), the tool post 4 can reverse the traveling direction thereof at an end point of the tool post 4 by the action of a mechanism described in detail later.

In FIG. 2, the driving pulley 2 is supported while allowing rotation on the frame 1 by a shaft 11, and is provided with a direction turning gear 2*a* and a driving gear 2*b*. The driving pulley 2, the direction turning gear 2*a* and the driving gear 2*b* are integrally configured in this embodiment.

The driving gear 2*b* provided on the driving pulley 2 engages with a reduction gear 8 supported by bearings of the frame 1. The reduction gear 8 is also engaged with a two-stage reduction gear 7, which is in turn engaged with a pinion 9 provided on an output shaft 10*a* of a motor 10. The motor 10 is secured through a motor bracket 13 to the frame 1. Driving the motor 10 rotates the pinion 9, the two-stage reduction gear 7, the reduction gear 8 and then the driving gear 2*b* in this order. This rotates the driving pulley 2. Rotating of the driving pulley 2 causes the endless wire 12 to travel. The tool post 4 connected through the sliding piece 6 to the endless wire 12 travels on the frame 1 while pulled by the endless wire 12.

The two-stage reduction gear 7, which is supported by bearings by the motor bracket 13 in this embodiment, may be supported by bearings as required on the frame 1 side. Any train of gears may be adopted provided the rotational force of the motor 10 is eventually transmitted to the driving gear 2*b*.

The tool post 4 is provided on the frame 1, allowing movement from right to left and vice versa in FIG. 1, and the rotary blade (not shown) is attached to the tool post 4, with the fixed blade (not shown) attached on the frame 1 side. This device cuts the sheet material in the same manner as in the conventional case with the assistance of the rotary blade and the fixed blade. A long guide hole 5 crossing the traveling direction of the endless wire 12 substantially at right angles is provided on the tool post 4, and the sliding piece 6 is provided in this long guide hole 5 allowing rotation and movement. The sliding piece 6 holds a node 12*a* of the endless wire 12 as shown in FIG. 2, and the endless wire 12 and the tool post 4 are connected by the sliding piece 6. Connection of the foregoing sliding piece 6 and the endless wire 12 is not limited to the node 12*a* of the endless wire, but it suffices that the sliding piece 6 is secured at an appropriate point on the endless wire. The tool post 4 can therefore travel on the frame 1 while being pulled by the endless wire 12 when the endless wire 12 moves. A direction turning member 6*a* is provided on the sliding piece 6, and this stopper member 6*a* can be engaged with a direction turning gear 2*a* provided on the foregoing driving pulley 2. While the direction turning member 6*a* is separate from the sliding piece 6 in this embodiment, the direction turning member 6*a* and the sliding piece 6 may be integrally formed.

The direction turning gear 2*a* and the sliding piece 6 having the construction as described above reverse the traveling direction of the tool post 4 upon arrival of the tool post 4 at the end point of travel as follows.

Upon arrival of the tool post 4 at the end point of travel on the left side in FIG. 1, the direction turning member 6*a* of the sliding piece 6 engages the rotating direction turning gear 2*a*. Under the effect of rotation of the direction turning gear 2*a*, the sliding piece 6 travels from one end toward the other end in the long guide hole 5 formed in the tool post 4. At a point where the sliding piece 6 has rotated by approximately 180 degree around a rotation shaft 11 of the driving pulley 2 (i.e., when the sliding piece 6 has traveled to the other end of the long guide hole 5), the sliding piece 6 disengages from the direction turning gear 2*a*, and the tool post 4 is pulled again by the sliding piece 6 in the opposite direction. It is therefore possible to change the action point where the tensile force of the endless wire 12 acts on the tool post 4 as a result of travel of the sliding piece 6 through the long guide hole 5 formed in the tool post 4 upon arrival of the tool post 4 at the end point of travel (in other words, this action point is the connecting point of the tool post 4 and the endless wire). It is thus possible to reverse the traveling direction of the tool post 4 at the end point of travel without changing the traveling direction of the endless wire 12 and without rotating the carriage or tool post 4.

It is important to previously form the long guide hole 5 of the tool post 4 substantially at right angle to the traveling direction of the tool post 4, and with a length at least equal to the diameter of the larger of the pulleys. Engagement of the sliding piece 6 and the stopper gear 2*a* can be smoothly started by providing the long guide hole 5 at a slight angle of inclination so that the end where the endless wire 12 begins to be wound on the driving pulley 2 slightly precedes in the traveling direction of the tool post 4 (i.e., as shown in FIG. 1). However, the direction of this inclination may be reversed. In summary, it suffices for the long guide hole 5 to have a function of causing the sliding piece 6 to travel from one end to the other end during the period from the beginning of winding of the endless wire 12 onto the driving pulley 2 up to leaving there. Therefore, the long guide hole 5 may not necessarily be a hole, but may be a guide such as a groove formed on the tool post 4. In this case, the sliding piece must have a shape permitting travel along such a groove.

Figure 3:
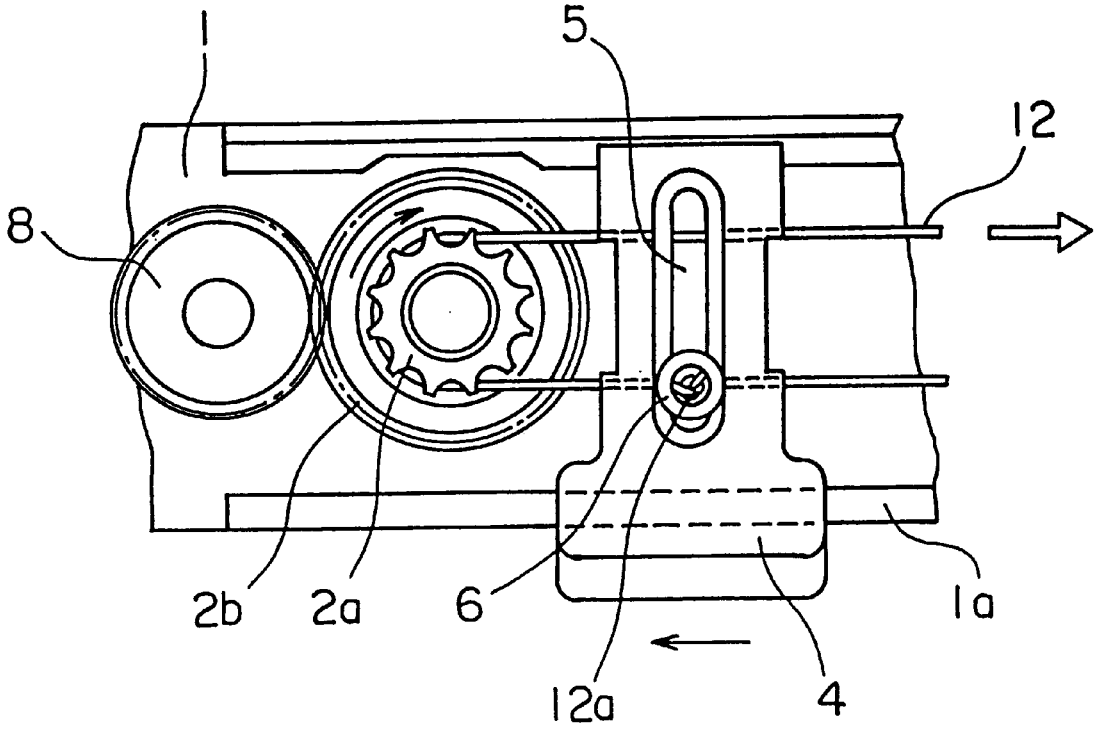
FIG. 3 is a plan view of the tool post approaching the end point of travel.
Figure 4A:
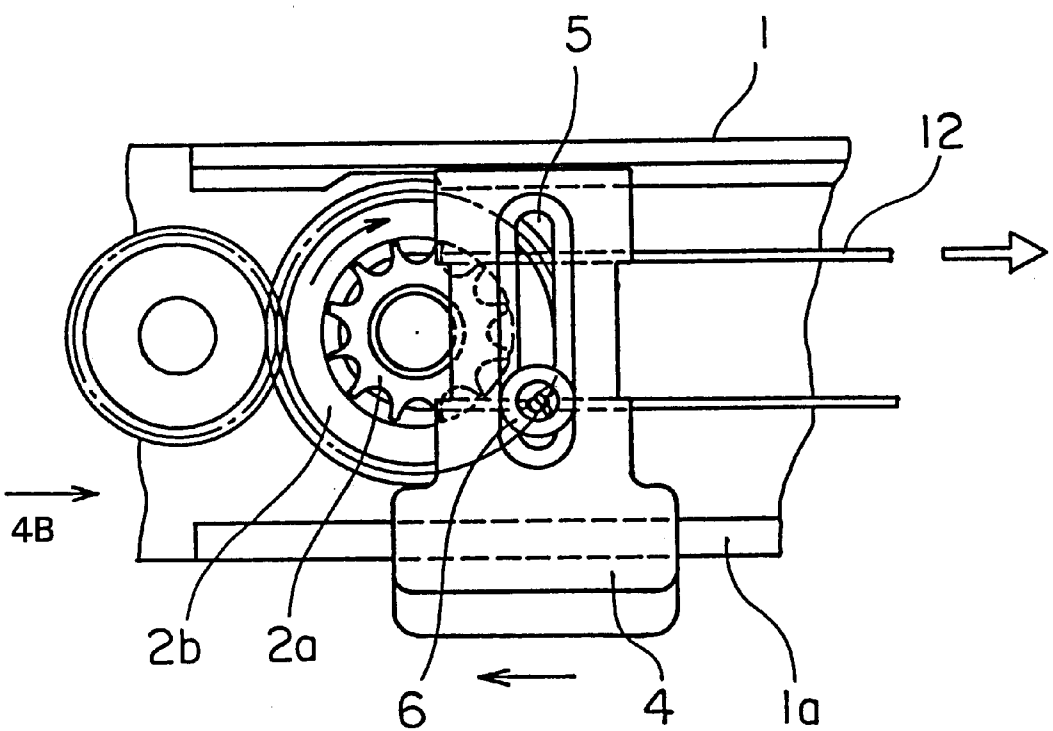
FIG. 4A is a plan view from the arrival of the carriage or the tool post at the end point of travel up to immediately prior to beginning engagement of a sliding piece with a direction turning gear.
Figure 4B:
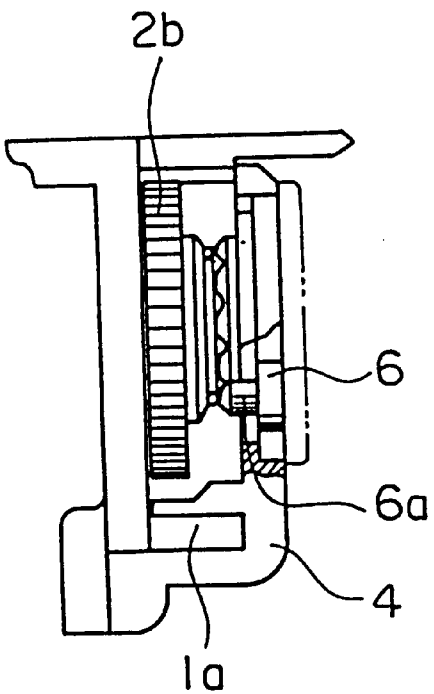
FIG. 4B is a sectional view thereof as viewed in the direction of arrow 4B of FIG. 4A.
Figure 5A:
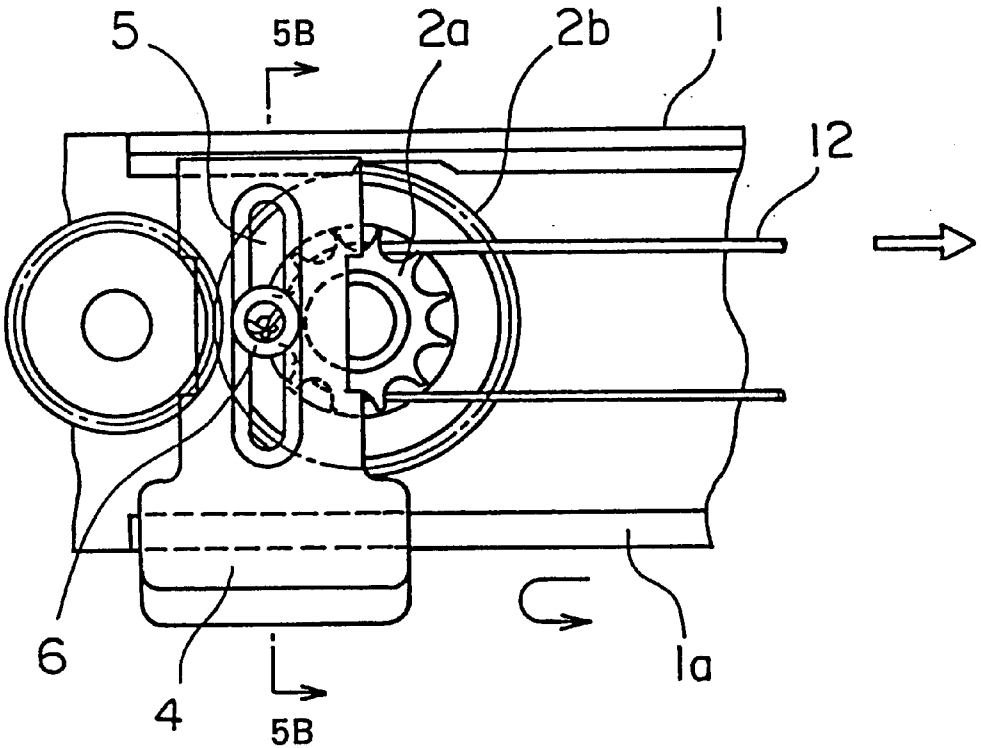
FIG. 5A is a plan view of a state in which the sliding piece provided on the tool post is engaged with the direction turning gear of the driving pulley.
Figure 5B:
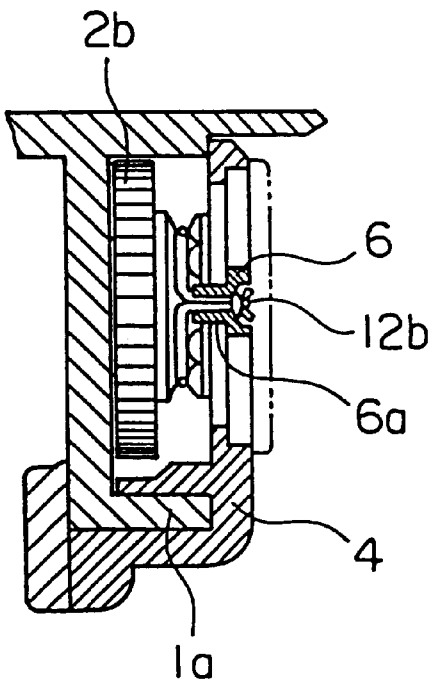
FIG. 5B is a sectional view thereof cut along the line 5B—5B of FIG. 5A.
Figure 6A:
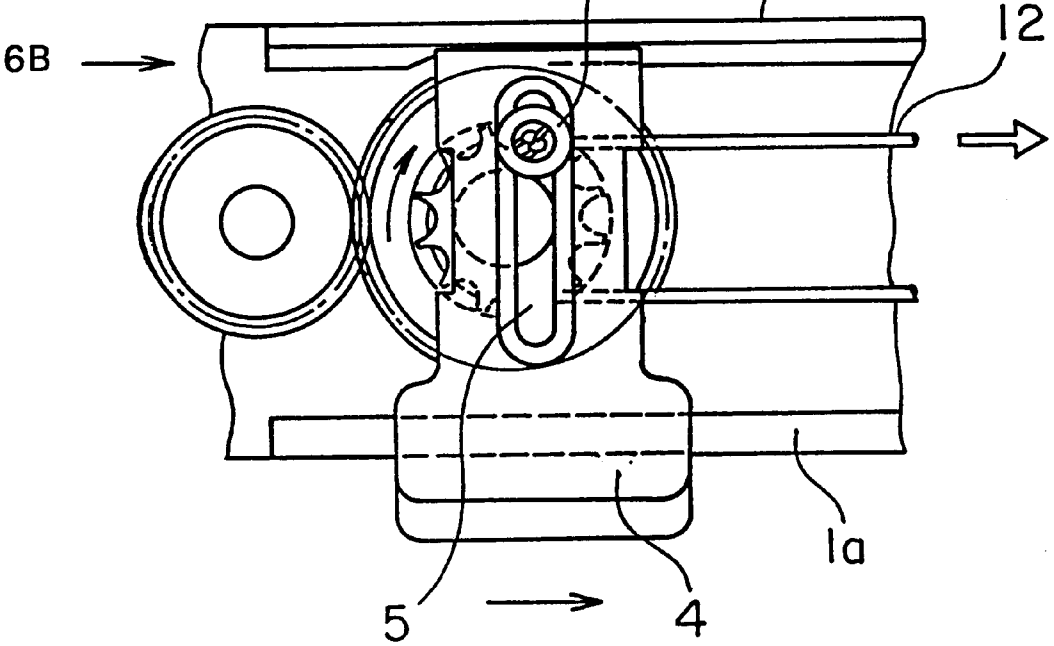
FIG. 6A is a plan view of a state of the sliding piece provided on the carriage or the tool post immediately prior to leaving the direction turning gear.
Figure 6B:
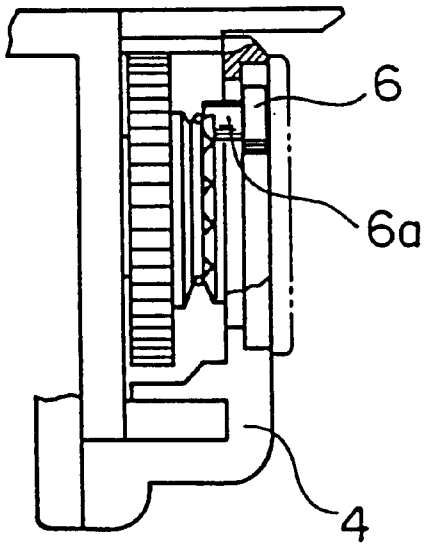
FIG. 6B is a sectional view thereof as viewed in the direction of arrow 6B of FIG. 6A.

This step will be described further in detail with reference to the drawings. FIG. 3 is a plan view illustrating the tool post 4 approaching an end point of travel at an end of the frame 1. FIG. 4A is a plan view immediately prior to beginning engagement of the sliding piece 6 with the stopper gear 2*a*, and FIG. 4B is a sectional view thereof as viewed in the direction of arrow 4B. FIG. 5A is a plan view in which the sliding piece 6 provided on the tool post 4 is engaged with the direction turning gear 2*a* of the driving pulley, and FIG. 5B is a sectional view thereof cut along the line 5B—5B; and FIG. 6A is a plan view of the sliding piece 6 provided on the tool post 4 immediately prior to leaving the stopper gear 2*a*, and FIG. 6B is a sectional view thereof as viewed in the direction of arrow 6B. In FIGS. 4A to 6B, the tool post 4 is substantially at a standstill at the end point of travel.

When the endless wire 12 is traveling in the direction of the arrow, as shown in FIG. 3, the sliding piece 6 holding a node of the endless wire 12 is at one end of the long hole 5 of the tool post 4 and continues to pull the tool post 4 toward the left in FIG. 3.

When the tool post 4 reaches the end point of travel, the sliding piece 6 engages the direction turning gear 2*a* of the driving pulley as shown in FIGS. 4A and 4B. Then, the sliding piece 6 travels toward the other end through the long guide hole 5 under the effect of the rotating stopper gear 2*a*, and through an intermediate state shown in FIGS. 5A and 5B travels in the long hole 5 to the other end. When engaged with the sliding piece 6 with the stopper gear 2*a* as shown in FIGS. 6A and 6B, the tool post 4 is pulled by the sliding piece 6 having a changed connecting point with the endless wire, and begins traveling again in the reversed direction. When the traveling direction of the tool post is reversed, the tool post moves slightly along with the movement of the sliding piece in the long hole.

Figure 7:
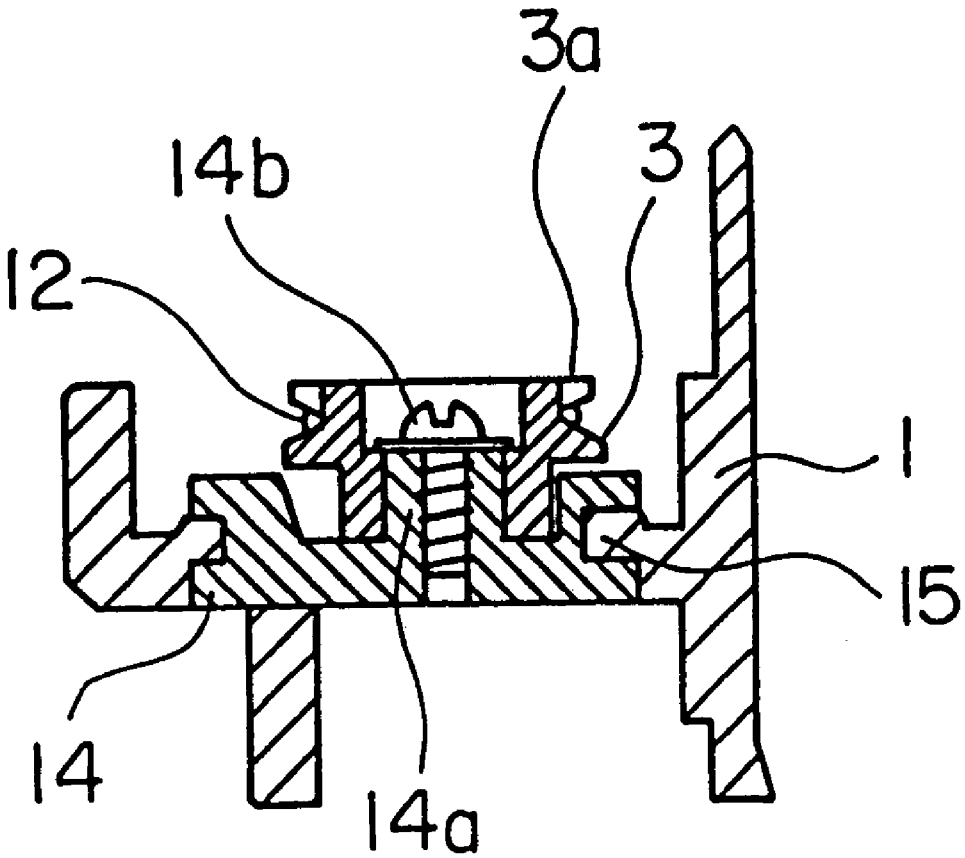
FIG. 7 is a sectional view of FIG. 1 cut along the line VII—VII.

The follower pulley 3 will now be described below with reference to FIGS. 1, 2 and 7. FIG. 7 is a sectional view of FIG. 1 cut along the line VII—VII.

The follower pulley 3 provided on the other end of the frame 1 has a direction turning gear 3*a* as shown in FIGS. 1 and 2, and these are constructed integrally. This follower pulley 3 is supported by bearings, allowing rotation by a shaft 14*a* on a sliding base 14. The sliding base 14 is on the other hand supported allowing movement in the longitudinal direction of the frame along a guide 15 formed on the frame 1 as shown in FIG. 7. In FIG. 7, 14*b* is a set-screw of the follower pulley. A spring 16 for imparting a force to the sliding base 14 toward the right in FIG. 1 is arranged between the sliding base 14 and the frame 1. The foregoing spring 16 imparts a tension to the endless wire 12 through the sliding base 14 and then the follower pulley 3. While the spring shown is a compression spring, a tension spring may be used in a modified arrangement. In summary, any mechanism capable of imparting a tension to the endless wire via the sliding base 14 may be adopted.

The endless wire 12 is held, as described above, by the sliding piece 6 at the node 12*a* thereof, and stretched between the driving pulley 2 and the follower pulley 3. When the motor 10 is driven and the driving pulley 2 is rotated, friction between the driving pulley 2 and the endless wire 12 causes the endless wire 12 to move. Since the node 12*a* of the endless wire 12 is held by the sliding piece 6 engaged in the long guide hole 5 of the tool post 4, the tool post 4 is pulled by the endless wire 12 to travel along the frame 1. Upon arrival of the tool post 4 at the end point of travel, the sliding piece 6 travels through the long guide hole 5 while the tool post 4 substantially stops as described above. The connecting point of the tool post 4 and the endless wire 12 is thus changed, and the tool post 4 begins traveling again in the reversed direction while being pulled by the endless wire 12.

The tool post 4 is guided relative to the frame 1 so as to avoid play, and tension is always applied to the endless wire 12 by the spring 16 provided between the sliding base 14 and the frame 1, thus eliminating any looseness of the endless wire 12.

In FIGS. 1 and 2, a positional sensor 17 that detects the standby position of the tool post 4 has a function of detecting arrival of the tool post 4 at the standby position after a run of reciprocation and stopping motor driving. The attachment position of this positional sensor 17 may be set at any appropriate point on the frame 1, and can of course be freely changed, depending upon the circumstances of cutting a sheet material. In FIG. 2, covers 4*a* and 4*b* are used for covering the tool post and are each attached to the tool post 4 by an appropriate device.

The operations of the tool post reciprocating mechanism of the sheet material cutting device in the foregoing first embodiment will now be described below.

In FIG. 1, assume that the tool post 4 travels toward the left in FIG. 1 along the frame 1. While the motor 10 is driven, the driving pulley 2 rotates sequentially through the pinion 9, the two-stage reduction gear 7, the reduction gear 8 and then the driving gear 2*b*, and the endless wire 12 continues to travel as well. Along with this, the tool post 4 travels to the left on the frame 1, together with the endless wire 12 via the sliding piece 6 holding the node 12*a* of the endless wire 12. When the direction turning member 6*a* of the sliding piece 6 engages with the direction turning gear 2*a* of the driving pulley 2, the sliding piece 6 moves from one end toward the other end in the long hole 5 under the effect of the rotating stopper gear 2*a*.

At a point when the sliding piece 6 reaches the other end in the long guide hole 5, engagement of the sliding piece 6 and the stopper gear 2*a* is released (a state in which the connecting point has been changed) (see FIGS. 3 to 6). In the meantime, the tool post 4 substantially stops, and in this state, the positional sensor 17 detects an optimum standby position of the tool post 4, and stops motor driving. Subsequently, when a sheet material cutting instruction is issued again, the motor driving is started, and the tool post 4 executes cutting of a sheet material. When the tool post 4 reaches the end point of travel at the other end of the frame, the follower pulley 3 changes the connecting point of the tool post 4 and the sliding piece 6, and the traveling direction of the tool post 4 is reversed to cause the tool post 4 to return to the foregoing standby position.

In the above-mentioned example of operation, the tool post 4 starts traveling from the motor side where it is attached to the frame 1, cuts the sheet material by means of the rotary blade and the fixed blade, and after reversal of the traveling direction at the follower pulley 3, returns back to the motor side where the positional sensor 17 stops motor driving. Upon receipt of another sheet material cutting instruction, the motor is driven, and the traveling direction of the tool post 4 is reversed at the driving pulley. The tool post 4 then cuts the sheet material by means of the rotary blade and the fixed blade, and then travels back to the standby position.

In this example of operation, as described above, it is possible to easily reverse the traveling direction of the tool post at the end point of travel while keeping a constant rotating direction of the motor and a constant traveling direction of the endless wire. A switching mechanism for switching over motor positive/negative rotations therefore becomes unnecessary, and in addition, only one sensor at the end point of travel need be installed, thus reducing the cost of the device as a whole.

A second embodiment of the present invention will now be described below with reference to FIGS. 8A through 12B.

The second embodiment is characterized in that the spring 16 imparting a tension to the endless wire in the first embodiment is incorporated in the tool post. As the tool post reciprocating mechanism in the second embodiment is the same as that in the first embodiment, only the features of the second embodiment will be described.

Figure 8A:
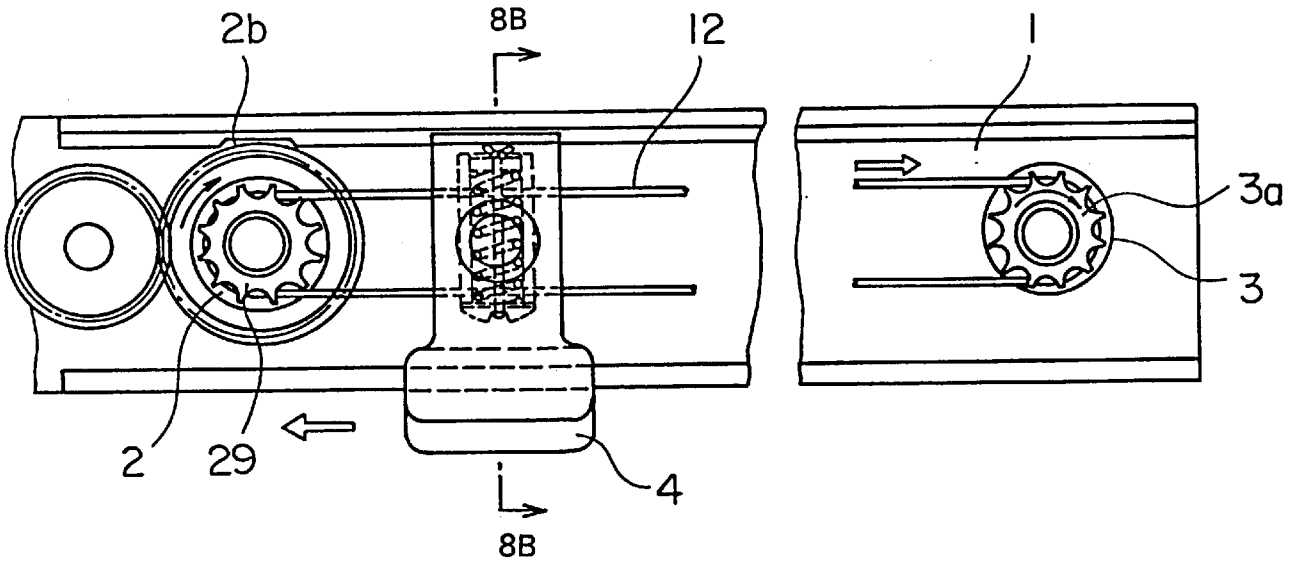
FIG. 8A is a plan view of a state in which a carriage or a tool post of a sheet material cutting device of a second embodiment of the present invention travels toward the end point of travel.
Figure 8B:
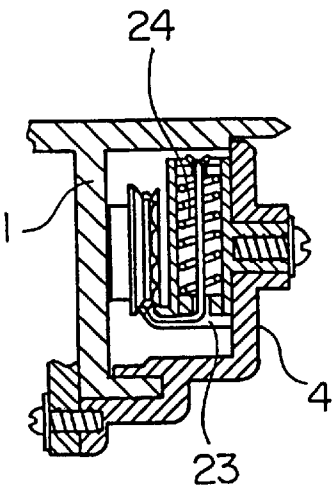
FIG. 8B is a sectional view thereof cut along the line 8B—8B of FIG. 8A.
Figures 9A, 9B:
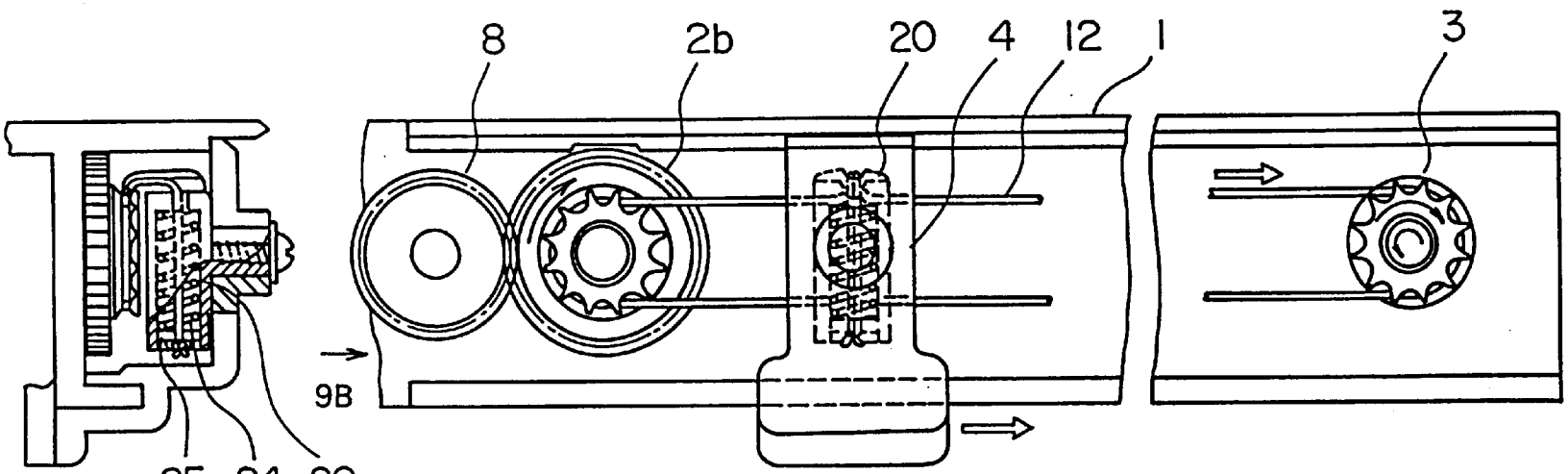
FIG. 9A is a plan view of a state in which the tool post travels from an end point of travel toward the other end point of travel.
FIG. 9B is a sectional view thereof as viewed in the direction of arrow 9B of FIG. 9A.
Figure 10B:
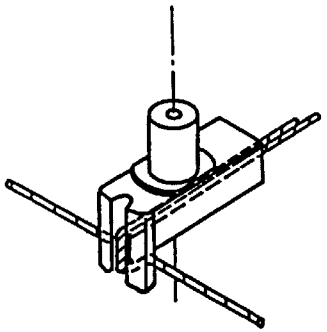
FIG. 10A is an exploded perspective view of the carriage or the tool post and FIG. 10B is a perspective view of the turn piece.
Figure 10A:
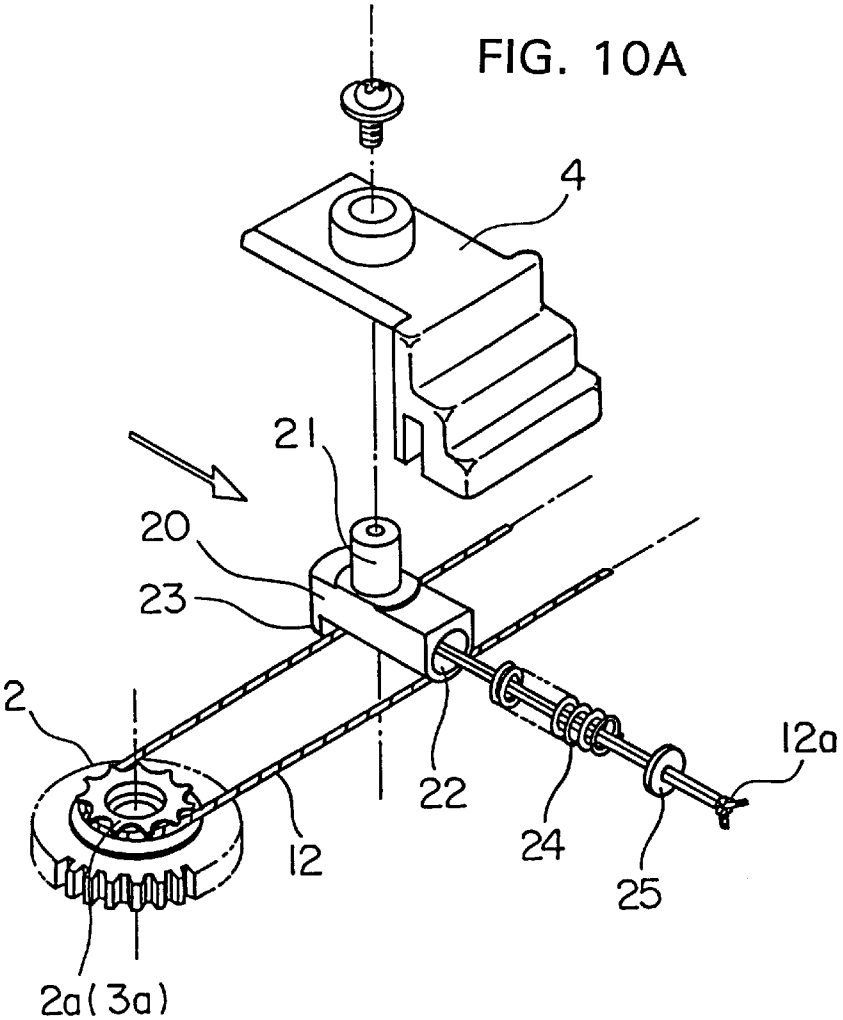
Figure 11A:
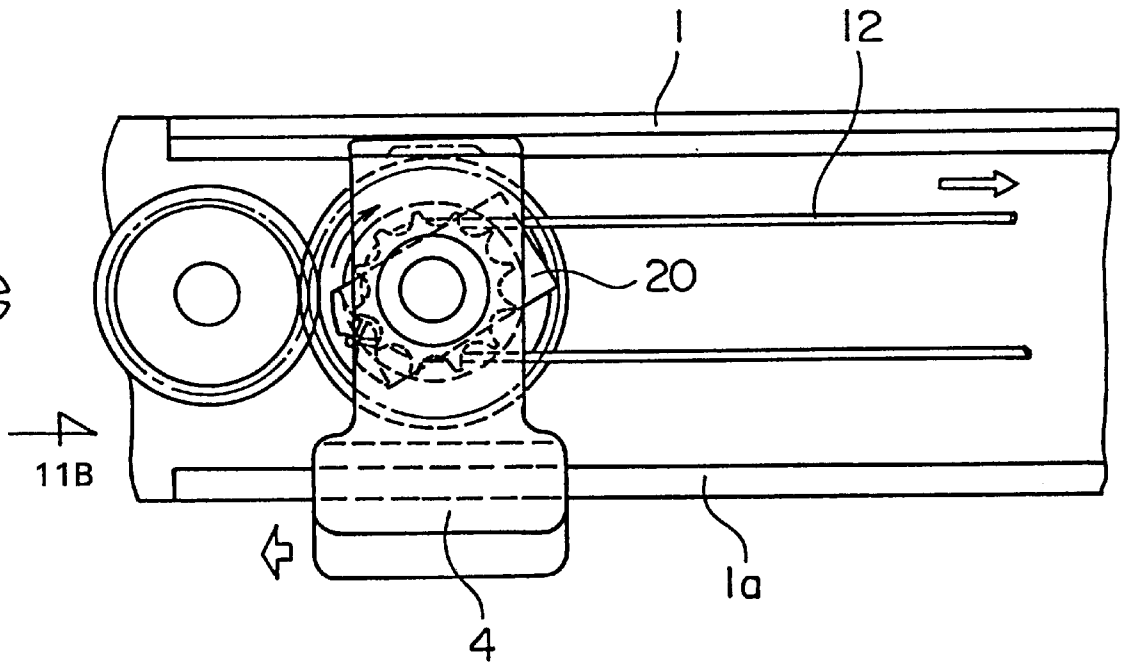
FIG. 11A is a descriptive view illustrating rotation of the turn piece at the end point of travel.
Figure 11B:
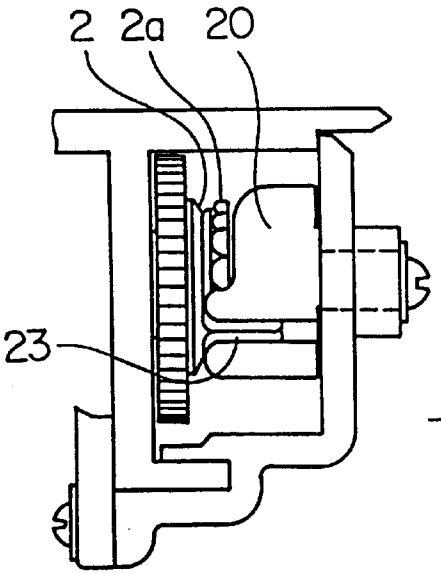
FIG. 11B is a sectional view thereof as viewed in the direction of arrow 11B of FIG. 11A.
Figure 12A:
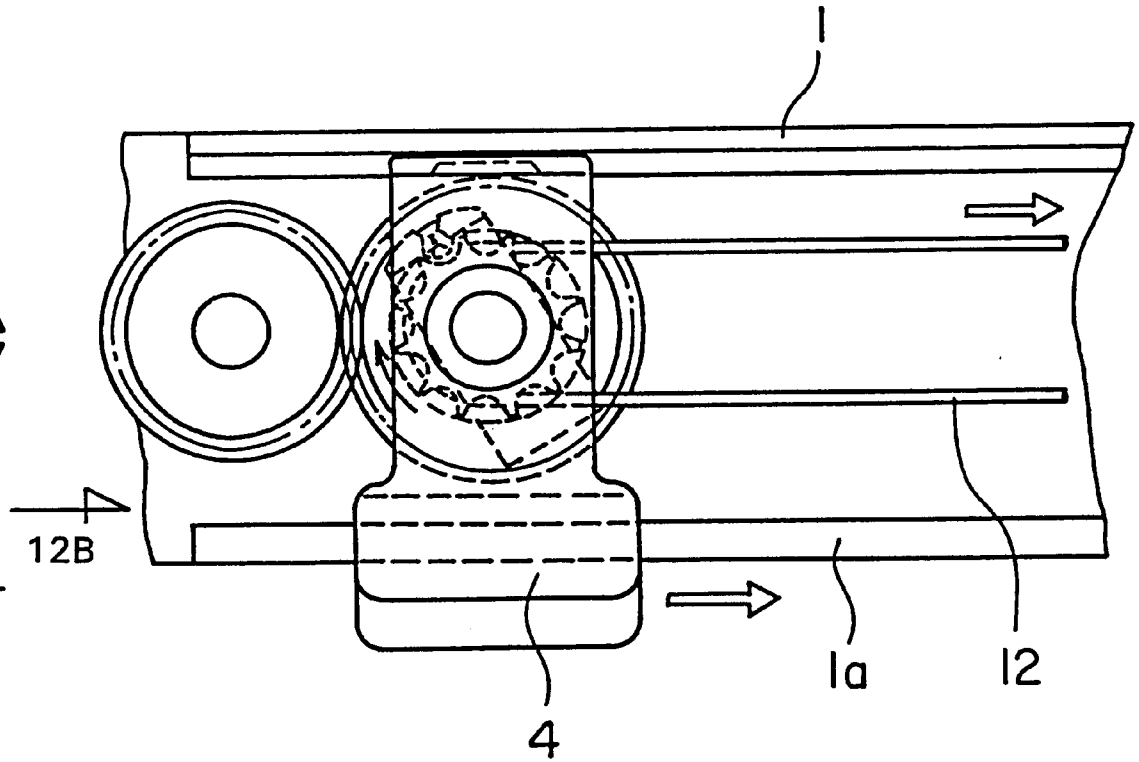
FIG. 12A is another descriptive view illustrating rotation of the turn piece at the end point of travel.
Figure 12B:
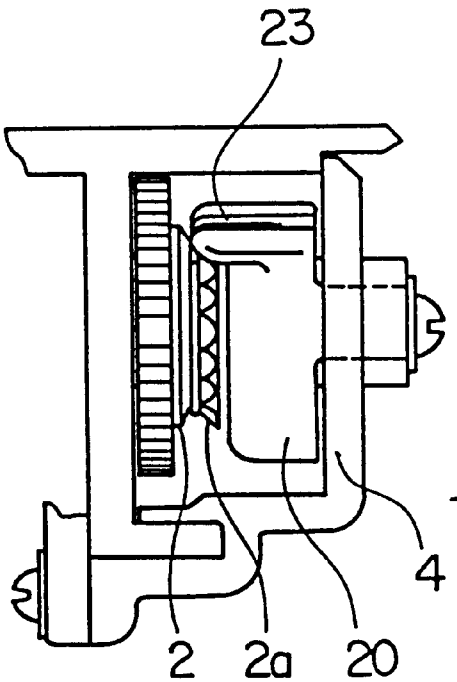
FIG. 12B is a sectional view thereof as viewed in the direction of arrow 12B of FIG. 12A.

FIG. 8A is a plan view illustrating the tool post traveling toward the end point of travel, and FIG. 8B is a sectional view thereof cut along the line 8B—8B of FIG. 8A. FIG. 9A is a plan view illustrating the tool post traveling from one end point of travel toward the other end point of travel, and FIG. 9B is a sectional view thereof as viewed in the direction of arrow 9B of FIG. 9A. FIG. 10A is an exploded perspective view of the tool post section and FIG. 10B is a perspective view of a turn piece. FIGS. 11A and 12A are perspective views illustrating rotation of the turn piece at the end point of travel. FIGS. 11B and 12B are sectional views as viewed in the directions of 11B and 12B of FIGS. 11A and 12A, respectively.

In FIGS. 10A and 10B, a turn piece 20 is provided by a shaft 21 on the tool post 4. A through-hole 22 is formed in the turn piece, and an engaging section 23 engaging with the stopper gears (2*a* and 3*a*) provided on the pulley side is formed on one end. A node 12*a* of the endless wire 12 is inserted into the through-hole 22 in the turn piece 20. The node 12*a* is further passed through a tension spring 24 and engages with the turn piece 20 at a stop ring 25. In this configuration, tension from the tension spring 24 always acts on the endless wire 12.

In this embodiment, the tool post 4 pulled by the endless wire travels toward the end point of travel as shown in FIG. 8, and upon arrival of the tool post 4 at the end point of travel, the engaging section 23 of the turn piece 20 engages the direction turning gear 2*a* (3*a*) in the same manner as in the principle of the first embodiment. The turn piece 20 changes the connecting point between the tool post 4 and the endless wire 12 while rotating around the shaft 21 (see FIGS. 11A, 11B, 12A and 12B). Then, the engaging section 23 of the turn piece 20 leaves the direction turning gear 2*a*, and as shown in FIGS. 9A and 9B, causes the tool post to travel toward the other end.

In this embodiment as well, it is possible to easily reverse the traveling direction of the tool post at the end point of travel while keeping a constant rotating direction of the motor and a constant traveling direction of the endless wire 12. Since the tension spring 24 is housed in the tool post 4 in this configuration, it is not necessary to provide a sliding base supporting the follower pulley 3 as in the first embodiment. Because the tension spring 24 is arranged within the tool post 4, the device can be finished into a smart appearance.

A third embodiment of the present invention will now be described with reference to FIGS. 13A through 13D.

In the third embodiment, a toothed belt 30 is used in place of the endless wire used in the first embodiment to serve as an endless belt. As the tool post reciprocating mechanism in this embodiment is the same as those in the first and the second embodiments, only the features of the third embodiment will be described.

Figure 13A:
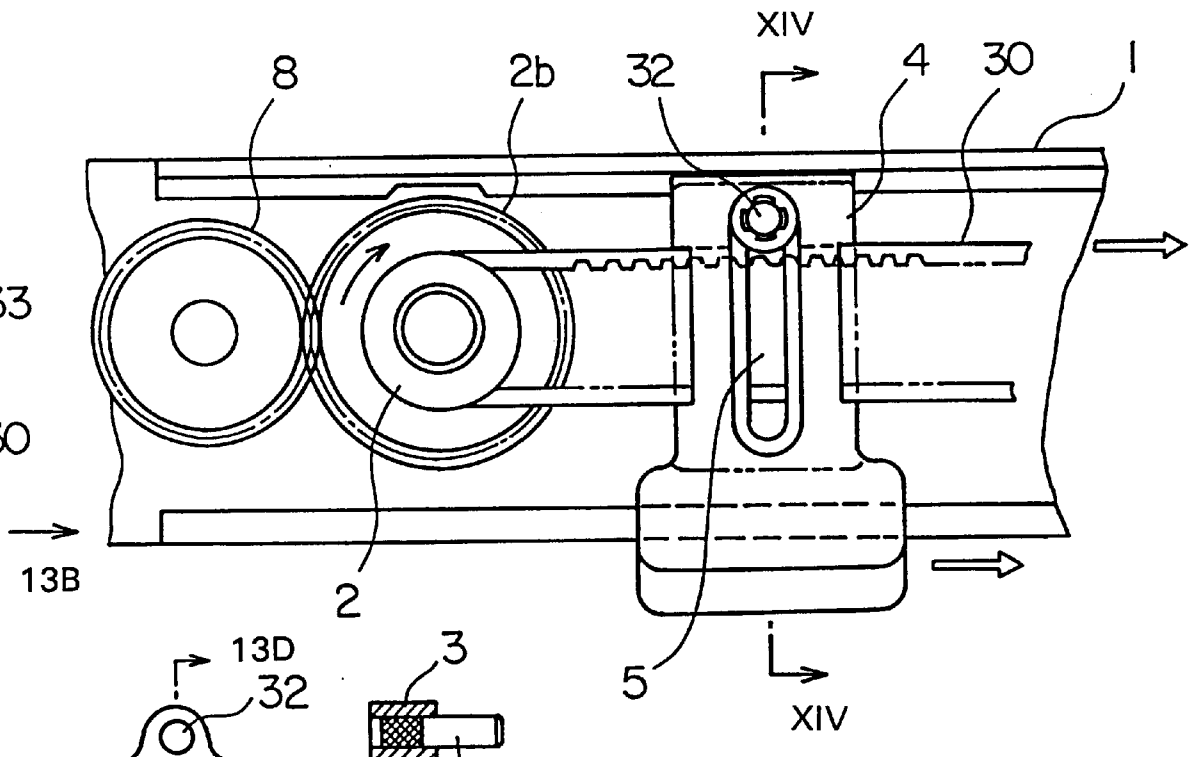
FIG. 13A is a plan view illustrating a third embodiment of the present invention.
Figure 13B:
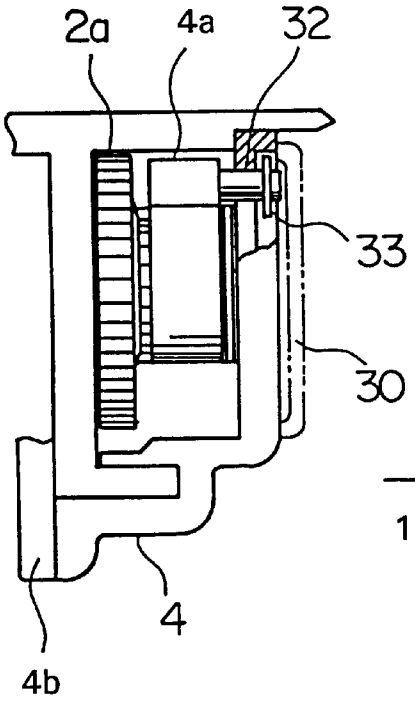
FIG. 13B is a sectional view thereof as viewed in the direction of arrow 13B.
Figure 13C:
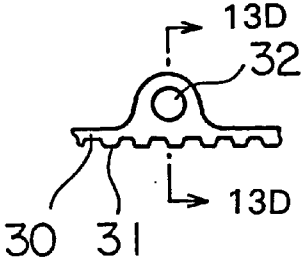
FIG. 13C is a partially enlarged view of the sliding piece section of a toothed belt.
Figure 13D:
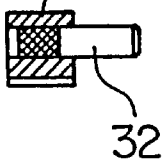
FIG. 13D is a sectional view thereof cut along the line 13D—13D of FIG. 13C.
Figure 14:
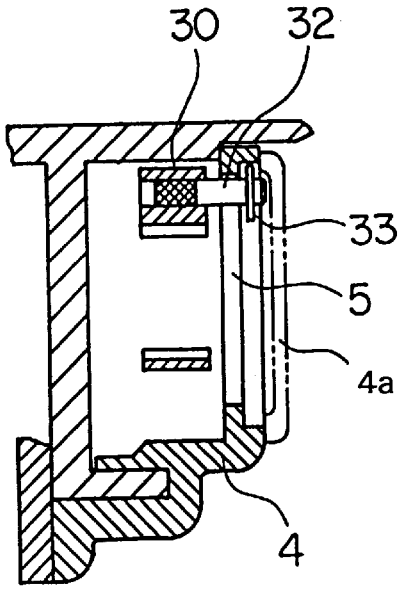
FIG. 14 is a sectional view of FIG. 13 cut along the line XIV—XIV.

FIG. 13A is a plan view illustrating the third embodiment. FIG. 13B is a sectional view thereof as viewed in the direction of arrow 13B of FIG. 13A, FIG. 13C is a partially enlarged view of the sliding piece of the toothed belt, and FIG. 13D is a sectional view cut along the line 13D—13D of FIG. 13C. FIG. 14 is a sectional view of FIG. 13A cut along the line XIV—XIV.

In the embodiment of FIGS. 13A–13D and 14, teeth 31 are formed on a belt 30. Gears (not shown) to engage with these teeth 31 of the belt are formed on the driving pulley and the follower pulley. A sliding piece 32 is integrally secured to the toothed belt 30 at a point, and this sliding piece 32 allows sliding through a long guide hole 5 formed in the tool post. When the tool post 4 reaches the end point of travel, in this embodiment as well, as under the principle of the first embodiment, the sliding piece 32 provided on the toothed belt 30 changes the connecting point between the tool post 4 and the toothed belt 30 while traveling through the long guide hole 5 of the tool post 4. In the drawings, covers 4*a* and 4*b* are attached to the tool post 4, and a washer 33 is provided at an end of the sliding piece 32. In this embodiment also, as described above, it is possible to easily reverse the traveling direction of the tool post at the end point of travel while keeping a constant rotating direction of the motor and a constant traveling direction of the endless wire.

As a toothed belt 30 is used in this embodiment, no slip occurs on the toothed belt 30, and the position of the tool post 4 can be accurately controlled. Integration of the sliding piece 32 and the toothed belt 30 permits the sliding piece 32 to be easily attached to the tool post 4 and thus reduces the manufacturing cost. In place of the sliding piece 32 in this embodiment, a turn piece 20 as described in the second embodiment may be provided on the toothed belt 30.

Figure 15:
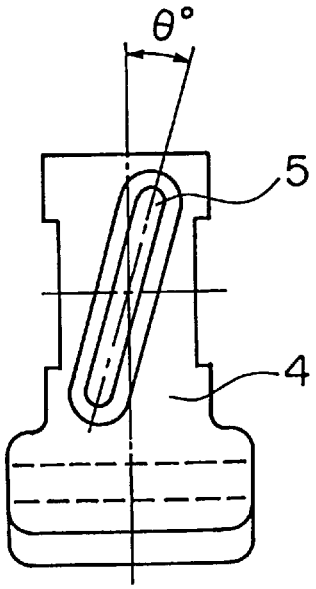
FIG. 15 illustrates another embodiment of a long hole provided in the tool post.
Figure 16:
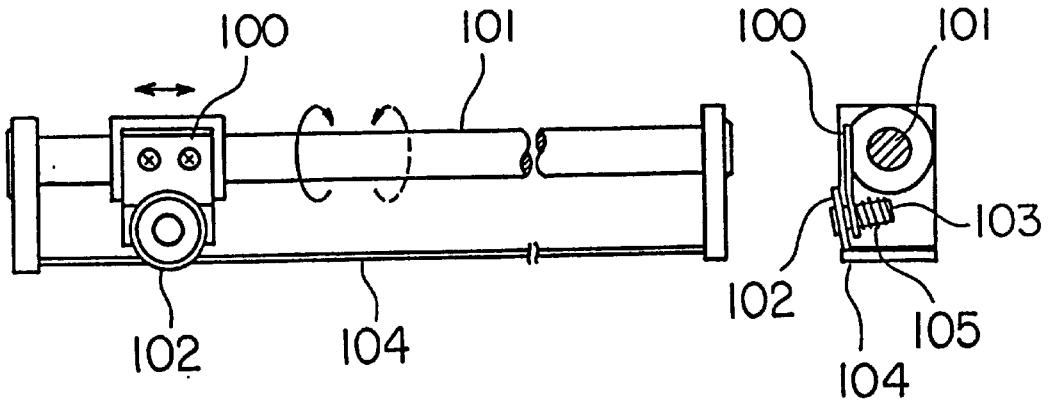
FIG. 16 PRIOR ART
FIG. 16 is a configuration diagram of a conventional sheet material cutting device.
Figure 17:
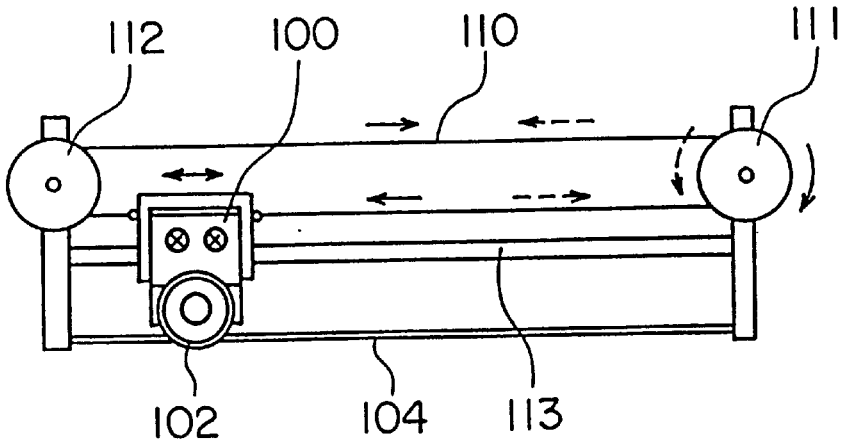
FIG. 17 PRIOR ART
FIG. 17 is a configuration diagram of another conventional sheet material cutting device.

In the present invention, as described above, it is possible in any of the embodiments to change the connecting point (the point where the tensile force of the endless wire acts on the tool post) between the tool post and the endless belt (includes an endless wire, an endless toothed belt, an endless rope, an endless chain, an endless cord and various other endless belts) at the end point of travel of the tool post. It is therefore possible to easily reverse the traveling direction of the tool post at the end point of travel while keeping a constant rotating direction of the motor and a constant traveling direction of the endless belt. A wide sheet material cutting device can be easily constructed by only changing the frame length and increasing the strength of the individual members to suit the nature of the sheet material to be cut. Sheet materials that can be cut by the application of the present invention include various sheets such as paper, cloth, various films and metal foil. The long hole 5 provided in the tool post may be inclined with a an angle of θ° in any of the embodiments as shown in FIG. 15, and the direction of inclination may be changed.

It is clear that, apart from the foregoing embodiments, the tool post reciprocating mechanism alone of the sheet material cutting device may be used for a reversing mechanism of any of various moving objects traveling by means of an endless belt stretched between a driving pulley and a follower pulley. In this case, it is not always necessary to guide the moving object relative to a frame as in the case of a tool post of a sheet material cutting device, but the moving object may be attached to an endless belt stretched in the air, provided the moving object can be reversed at the end point of travel. As the reversing mechanism of the moving object has substantially the same functions as those of the tool post reciprocating mechanism, description thereof is omitted.

Various other variations of the present invention are possible without departing from the spirit or major features thereof. The foregoing embodiments are therefore only examples and should not be construed to be limitative. Furthermore, variations and modifications falling under ranges equivalent to those of the claims are within the scope of the present invention.

According to the tool post reversing mechanism of the present invention, as described above in detail, it is possible to easily reverse the traveling direction of the tool post, without changing the rotating direction of the motor or the traveling direction of the endless wire and without rotation of the carriage or the tool post, by material cutting device can be easily constructed by only changing the frame length and increasing the strength of the individual members to suit the nature of the sheet material to be cut. Sheet materials which can be cut by the application of the present invention include various sheets such as paper, cloth, various films and metal foil. The long guide hole 5 provided in the carriage or tool post 4 may be inclined with a an angle of θ° in any of the embodiments as shown in FIG. 15, and the direction of inclination may be changed.

It is clear that, apart from the foregoing embodiments, the tool post reciprocating mechanism alone of the sheet material cutting device may be used for a reversing mechanism of any of various moving objects traveling by means of an endless belt stretched between a driving pulley and a follower pulley. In this case, it is not always necessary to guide the moving object relative to a frame as in the case of a tool post of a sheet material cutting device, but the moving object may be attached to an endless belt stretched in the air, provided the moving object can be reversed at the end point of travel. As the reversing mechanism of the moving object has substantially the same functions as those of the tool post reciprocating mechanism, description thereof is omitted.

Various other variations of the present invention are possible without departing from the spirit or major features thereof. The foregoing embodiments are therefore only examples and should not be construed to be limitative. Furthermore, variations and modifications falling under ranges equivalent to those of the claims are within the scope of the present invention.

According to the tool post reversing mechanism of the present invention, as described above in detail, it is possible to easily reverse the traveling direction of the tool post, without changing the rotating direction of the motor or the traveling direction of the endless wire and without rotation of the carriage or the tool post, by changing the action point of the tool post and the endless belt through movement of a sliding piece connecting the tool post and the endless belt on the tool post. As a result, it is possible to reduce the number of sensors to be provided at the end point of travel from the conventional two to one, and it becomes unnecessary to provide a switching mechanism for changing the rotating direction of the motor. In addition, when this reversing mechanism is applied for a tool post reciprocating mechanism of a sheet material cutting device, the present invention permits reduction of the number of sensors used in the sheet material cutting device and elimination of a switching mechanism for changing the rotating direction of the motor, thus allowing equipment cost to be considerably reduced.

The entire disclosure of Japanese Patent Application No. 8-159572 filed on Jun. 20, 1996 and U.S. Pat. No. 5,307,716, including specification, drawings and claims are herein incorporated by reference in its entirety.

What is claimed is:

1. A reciprocating mechanism of a sheet material cutting device, comprising:

a frame having a first end and a second end, and supporting a fixed blade;

a carriage holding a rotary blade movably mounted to the frame, reciprocating between the first end and the second end, the rotary blade contacting the fixed blade as the carriage reciprocates between the first end and the second end of the frame;

a driving pulley rotatably mounted at the first end of the frame;

a driven pulley rotatably mounted at the second end of the frame;

an endless wire stretched between the driving pulley and the driven pulley, the endless wire being connected to the carriage, the endless wire having a node connecting portions of the wire to form an endless loop;

a sliding base movable relative to the frame, the sliding base supporting the driven pulley and being pushed by a spring to tension the endless wire; and a driving mechanism in driving engagement with the driving pulley, wherein the driving mechanism drives the driving pulley in one direction to move the endless wire in one direction, wherein the carriage reverses the direction of the movement as the wire is driven in one direction, thus reciprocating back and forth between a distance separating the driven and driving pulleys, wherein carriage includes means for changing the direction of the carriage at the driven and driving pulleys and maintaining the carriage stationary at the driven and driving pulley before the carriage is changing direction, wherein the direction changing means includes a direction turning gear arranged on each of the driving and driven pulleys, a slot formed on the carriage, and a slideable member guided oil the slot, the slideable member engaging the direction turning gear and maintaining the carriage stationary while engaging the direction gear, and wherein the slideable member holds the node of the endless wire, connecting the endless wire to the carrier via the slideable member.

2. A reciprocating mechanism of a sheet material cutting device according to claim 1, wherein the slot is substantially perpendicular to the traveling direction of the carriage.

3. A reciprocating mechanism of a sheet material cutting device according to claim 2, wherein the slot has a length at least equal to a diameter of the driving pulley, the driving pulley being larger than the driven pulley.

4. A reciprocating mechanism of a sheet material cutting device according to claim 1, wherein the slot is inclined from a direction perpendicular to the traveling direction of the carriage.

5. A reciprocating mechanism of a sheet material cutting device, comprising:

a frame having a first end and a second end, and supporting a fixed blade;

a carriage holding a rotary blade movably mounted to the frame, reciprocating between the first end and the second end, the rotary blade contacting the fixed blade as the carriage reciprocates between the first end and the second end of the frame;

a driving pulley rotatably mounted at the first end of the frame;

a driven pulley rotatably mounted at the second end of the frame;

an endless wire stretched between the driving pulley and the driven pulley, the endless wire being connected to the carriage, the endless wire having a node connecting portions of the wire to form an endless loop;

a spring tensioner that tensions the endless wire; and a driving mechanism in driving engagement with the driving pulley, wherein the driving mechanism drives the driving pulley in one direction to move the endless wire in one direction, wherein the carriage reverses the direction of the movement as the wire is driven in one direction, thus reciprocating back and forth between a distance separating the driven and driving pulleys, wherein carriage includes means for changing the direction of the carriage at the driven and driving pulleys and maintaining the carriage stationary at the driven and driving pulley before the carriage is changing direction, wherein the direction changing means comprises a turn piece connected to the endless wire and rotatably mounted to the carriage, and a direction turning gear arranged on each of the driving and driven pulleys, the turn piece engaging the direction turning gear and maintaining the carriage stationary while the direction turning gear engages the turn piece, wherein the turn piece rotates approximately 180 degree relative to the carriage, along with the rotation of the respective pulley when the turn piece engages the respective direction turning gear, wherein the turn piece has a hole, the spring tensioner comprising a spring positioned in the hole and a stopper, and wherein the endless wire extending through the hole and the stopper, the stopper holding the node of the endless wire and connecting the endless wire to the turn piece and thereby connecting the endless wire to the carriage.

* * * * *